US007263989B2

(12) United States Patent
Yamauchi et al.

(10) Patent No.: US 7,263,989 B2
(45) Date of Patent: Sep. 4, 2007

(54) HIGH-FREQUENCY HEATING APPARATUS EQUIPPED WITH OVEN HOOD

(75) Inventors: Masato Yamauchi, Kyoto (JP); Toshiyuki Ishiguro, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 205 days.

(21) Appl. No.: 10/900,712

(22) Filed: Jul. 28, 2004

(65) Prior Publication Data

US 2005/0087184 A1 Apr. 28, 2005

(30) Foreign Application Priority Data

Jul. 29, 2003 (JP) ..... P.2003-281616
Sep. 3, 2003 (JP) ..... P.2003-311502
Sep. 10, 2003 (JP) ..... P.2003-318024

(51) Int. Cl.
*F24C 15/04* (2006.01)
*E05F 1/10* (2006.01)

(52) U.S. Cl. ..... 126/192; 126/198; 49/386

(58) Field of Classification Search ..... 126/192 O, 126/198 X, 299 D, 299 R; 49/386 X, 387; 454/49

See application file for complete search history.

(56) References Cited

U.S. PATENT DOCUMENTS 6,291,809 B1 * 9/2001 Ha ..... 219/757
6,335,521 B1 1/2002 Jeong et al.

* cited by examiner

*Primary Examiner*—Alfred Basichas
(74) *Attorney, Agent, or Firm*—Pearne & Gordon LLP

(57) ABSTRACT

An apparatus includes a cam 3, a lever 8, a switch 10, a spring 9 and fire detection means 15. Utilizing an interlocking movement and an operation of the switch, a motor 2 is driven under a microcomputer control 23, and by doing so, the automatic opening and closing movement of a cover 1 can be effected smoothly and stably. Even when a fire occurs at a cooking device 13 below the apparatus, the fire detection means 15 stops the operation of a circulating fan 11, and also stops the cover 1 in an open condition, and by doing so, the spreading of the fire can be limited to a minimum, and also an abnormality in the opening and closing of the cover 1 can be indicated at a display portion 23, and therefore the safety, the durability and the degree of satisfaction of customers can be enhanced.

9 Claims, 14 Drawing Sheets

P0: INITIAL HEATING OUTPUT
P1: OUTPUT AT TIME OF FINISH OF COOKING IN NORMAL OPERATING CONDITION
P2: STABLE OUTPUT WHEN ABNORMALITY OCCURS t1: TIME OF OCCURRENCE OF ABNORMALITY
t2: COOKING FINISH TIME IN NORMAL CONDITION
t3: COOKING FINISH TIME AFTER CORRECTION WHEN ABNORMALITY OCCURS

HIGH-FREQUENCY HEATING APPARATUS EQUIPPED WITH OVEN HOOD

BACKGROUND OF THE INVENTION

This invention relates to an oven hood-equipped high-frequency heating apparatus which has the function of exhausting gas generated from other heating cooking device installed below an apparatus body, and is of such a construction that an exhaust opening cover, provided at an exhaust opening for discharging the generated gas from the apparatus body, is automatically opened and closed by driving a motor.

A conventional exhaust opening cover can be automatically opened and closed to secure a high degree of opening when it becomes necessary to ventilate a room by a ventilation fan or when it becomes necessary to secure an intake opening so as to cool a heating part during the operation of a high-frequency heating apparatus. In addition, in an inoperative condition, such a conventional exhaust opening cover is held in a closed condition to assume a flat appearance, so that the design can be enhanced, and also the intrusion of dust and dirt can be prevented (see, for example, U. S. Pat. No. 6,335,521).

For example, the opening and closing of most of such exhaust opening covers have been effected only by mechanical means utilizing the operation of a stepping motor which can limit its rotating direction.

FIGS. 3A and 3B show the opening and closing of an exhaust opening cover of a conventional apparatus.

The conventional apparatus includes an exhaust opening cover 1, a motor 2 for automatically opening and closing the cover, a cam 3 for converting the rotation of a motor shaft into a moment, a boss 3-*a* formed on the cam so as to transmit power to a part connected to the cam, a part 4 (constituting the exhaust opening cover) for receiving the rotational movement of the cam, a slit 4-*a* which is formed in the exhaust opening cover-constituting part, and is connected to the boss formed on the cam, and a rotation shaft 5 of the exhaust opening cover, an exhaust opening portion 6, and a draft 7 of exhaust discharged from the apparatus.

In the above conventional construction, however, the exhaust opening cover portion and the motor shaft portion are integrally interconnected, and the driving force of the motor is all applied to one point, that is, to the boss formed on the cam. Therefore, an undue stress develops in a force-transmitting direction, and the durability of the interconnecting moving portions is adversely affected, so that it has been difficult to secure the reliability. And besides, since the stepping (rotational direction-limiting) motor is used for the exhaust opening cover, it has been difficult to secure the quality of the motor. Furthermore, when the exhaust opening cover is forcibly opened and closed by applying a force to the exhaust opening cover from the exterior, this force is transmitted as an overload directly to the motor because of the integrally-interconnecting construction, and this leads to a factor in malfunction of the motor. Thus, these problems, relating to the product quality, have been encountered.

SUMMARY OF THE INVENTION

This invention seeks to solve the problems of the conventional technique, and an object of the invention is to provide an oven hood-equipped high-frequency heating apparatus which can achieve a stable quality with a simple construction, and can greatly improve the efficiency of an operation for assembling a product, and is excellent in performance per cost, and can satisfy users, and is safe, and is of a high quality.

According to first aspect of the present invention, an oven hood-equipped high-frequency heating apparatus having the function of automatically opening and closing a motor-driven exhaust opening cover, comprises a motor of the unidirectional type, and a cam and a lever for converting a rotation of the motor into a force to open the cover in a pushing manner, and when the cover reaches a predetermined optimum open position, a single microswitch is operated to feed a signal to a control portion. With this simple construction, the cover can be opened and closed, and the motor and the opening/closing mechanism parts are enhanced in durability reliability, and the stability of the opening and closing operation is enhanced, and the quality for dealing with an external stress, forcibly applied to the cover as by a mischief, is secured, and when an abnormality occurs in the opening and closing of the cover, a fan and a heating operation are controlled so as to protect the electric parts from damage, and also such an abnormal condition is told by indicating an abnormality in the opening and closing of the cover, and the efficiency of the assembling operation and the product cost can be greatly improved.

Therefore, the motor of a high durability reliability can be used, and the durability performance and the quality-stabilizing performance can be greatly enhanced with the structure by which the driving force of the motor can be smoothly converted into a cover-opening and closing motion.

In the present invention, there can be achieved the oven hood-equipped high-frequency heating apparatus in which the smooth and stable opening/closing operation can be effected with the simple construction, and the safety, durability performance and appearance grade are excellent According to second aspect of the invention, an oven hood-equipped high-frequency heating apparatus of the present invention, having the function of automatically opening and closing a motor-driven exhaust opening cover, comprises opening/closing means including protruding means for opening the cover in association with the driving of a motor and pressing means for closing the cover, and when the cover reaches a predetermined position, the driving of the motor is stopped, so that the cover is kept in an open condition by the protruding means, and when the cover in the open condition is to be closed, the motor is driven in a reverse direction, and also the cover is closed by the pressing means. In this construction, there are used the motor of the ordinary bidirectional type and a cam and a lever which cooperate with each other to convert a rotation of the motor into a force to open the cover in a pushing manner, and when the cover reaches a predetermined optimum open position, a single microswitch is operated to feed a signal to a control portion. With this simple construction, the cover can be opened and closed, and the motor and the opening/closing mechanism parts are enhanced in durability reliability, and the stability of the opening and closing operation is enhanced, and the quality for dealing with an external stress, forcibly applied to the cover as by a mischief, is secured, and when an abnormality occurs in the opening and closing of the cover, a fan and a heating operation are controlled so as to protect the electric parts from damage, and also such an abnormal condition is told by indicating an abnormality in the opening and closing of the cover, and the efficiency of the assembling operation and the product cost can be greatly improved.

Therefore, the motor of a high durability reliability can be used, and the durability performance and the quality-stabilizing performance can be greatly enhanced with the structure by which the driving force of the motor can be smoothly converted into a cover-opening and closing motion.

In the present invention, there can be achieved the oven hood-equipped high-frequency heating apparatus in which the smooth and stable opening/closing operation can be effected with the simple construction, and the safety, durability performance and appearance grade are excellent According to third aspect of the invention, an oven hood-equipped high-frequency heating apparatus of the present invention, having the function of automatically opening and closing an exhaust opening cover by utilizing a current of air produced by a circulating fan, is constructed such that part of a lever receives an exhaust current during the operation of the circulating fan to push out the cover, thereby opening the cover, and when the operation of the circulating fan is stopped, the cover is closed by the pressing means.

When the cover is closed, a microswitch is operated, and with this construction an abnormality in the opening and closing of the cover can be detected in a self-diagnosable manner, and in the event of an abnormality, the operation of the circulating fan is stopped, or the abnormality is indicated at a display portion of the apparatus body, thereby telling the use of the abnormality. Therefore, the abnormality in the opening and closing movement of the cover can be detected immediately, and a malfunction of the circulating fan can be prevented, and the quality and the cost can be greatly improved with the simple construction.

Therefore, the cover can be opened and closed by the force of the exhaust current without the use of a motor driving force, and the smooth opening and closing movement can be achieved, and besides the durability performance and the quality-stabilizing performance can be greatly enhanced.

In the present invention, there is achieved the oven hood-equipped high-frequency heating apparatus which enables the smooth and stable opening and closing operation with the simple construction, and is excellent in safety and appearance grade.

BRIEF DESCRIPTION OF THE DRAWINGS

FIG. 4A shows the embodiment of the invention, while FIG. 4B shows the conventional construction.

DETAILED DESCRIPTION OF THE PREFERRED EMBODIMENTS

First Embodiment

Figure 1:
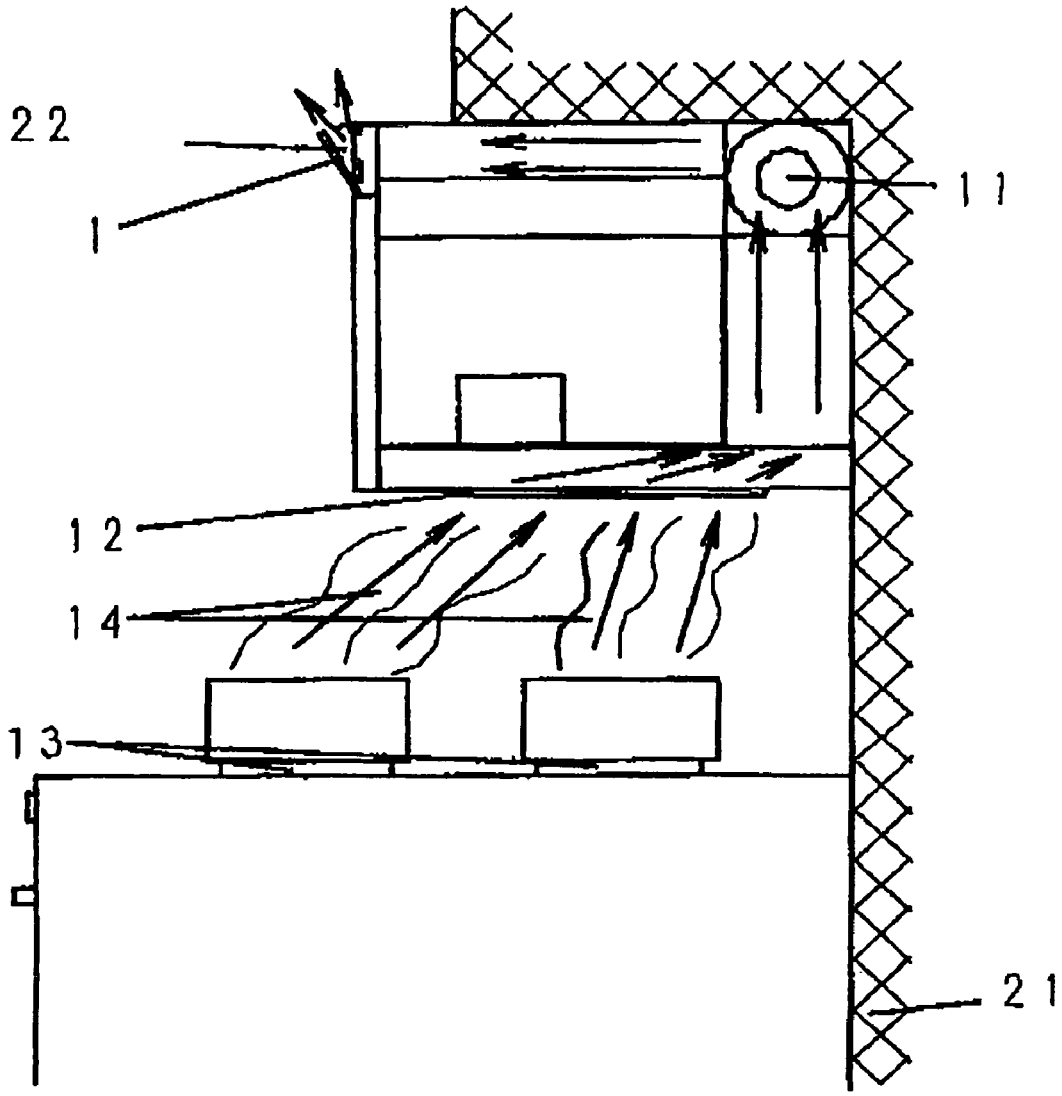
FIG. 1 is a view showing a condition in which a first embodiment of an oven hood-equipped high-frequency heating apparatus of the invention, having an exhaust opening cover provided with an automatic opening/closing device, is installed.
Figure 2:
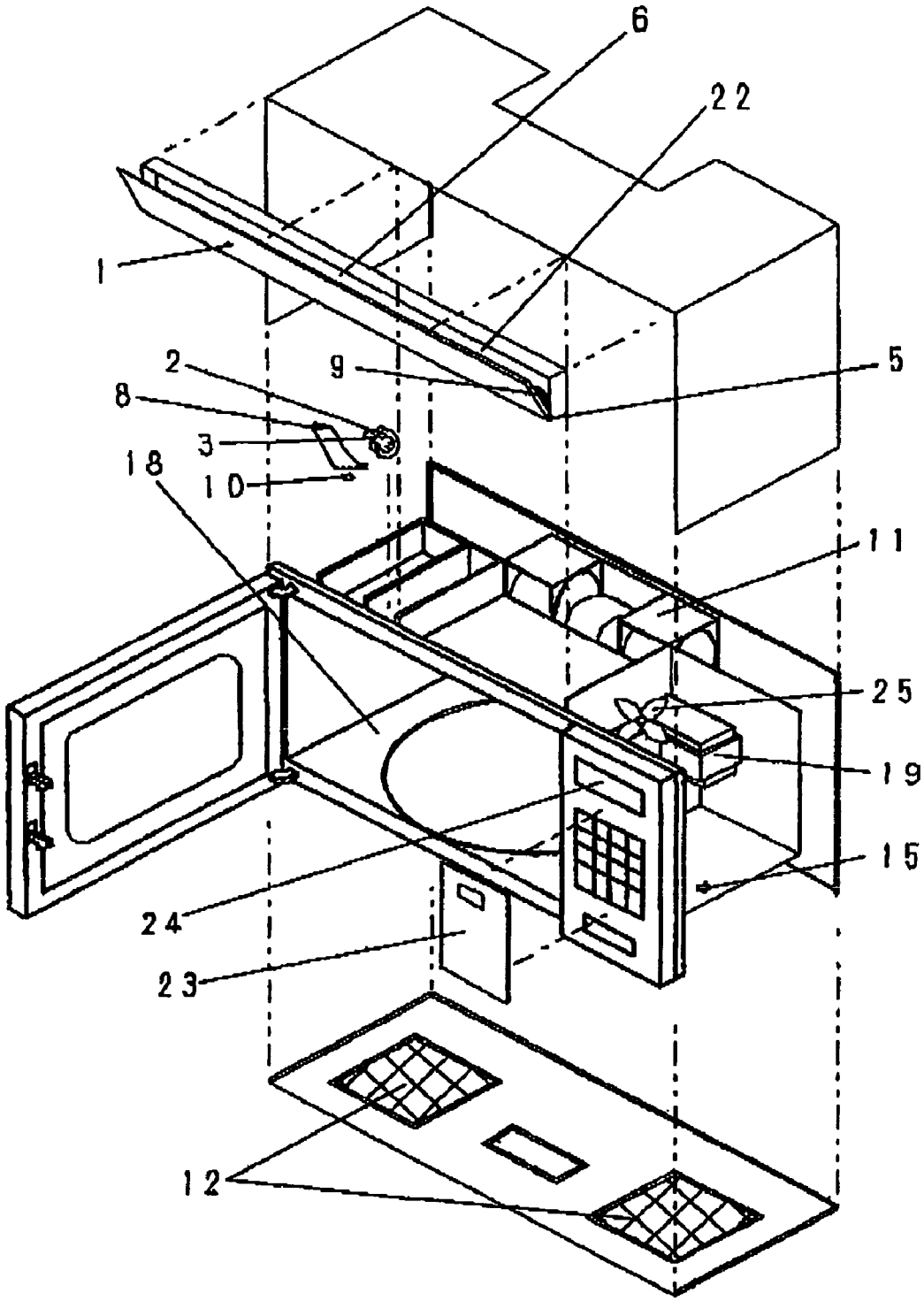
FIG. 2 is a view showing the internal structure of the oven hood-equipped high-frequency heating apparatus of the first embodiment provided with the exhaust opening cover.
Figure 3A:
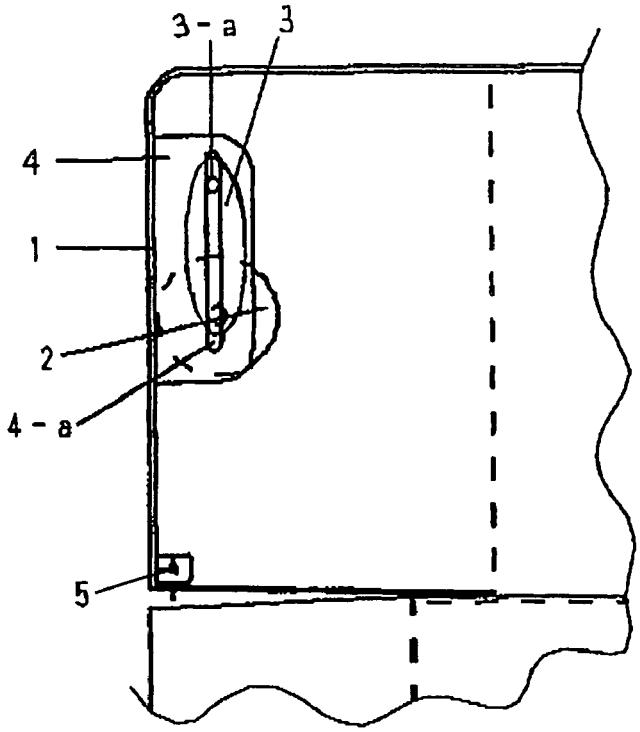
FIGS. 3A and 3B show the opening and closing of an exhaust opening cover of a conventional apparatus.
Figure 3B:
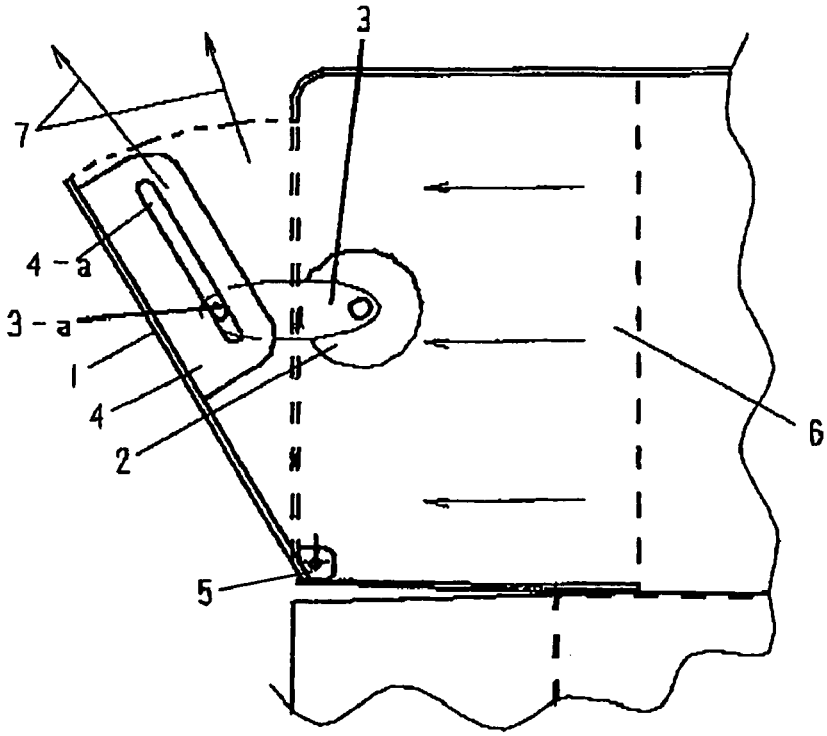

In FIGS. 1 and 2, the exhaust opening cover 1, provided with the automatic opening/closing device, is so constructed that gas 14, generated from cooking devices 13 (installed below the exhaust opening cover) during the cooking, is drawn up through bottom surface intake openings 12 by a circulating fan 11, and is circulated to be exhausted into a room through an upper surface portion of an apparatus body when the exhaust opening cover 1 (which can be automatically opened and closed by driving a motor 2) is in an open condition, and that an intake opening 22 for cooling an electric part (serving as a heating member) during an operation of heating means 19 is provided at the exhaust opening cover 1 disposed at an upper portion of the apparatus body. The operation and effects of the oven hood-equipped high-frequency heating apparatus, having the exhaust opening cover 1 provided with the automatic opening/closing device of the above construction, will be described below.

Figure 5:
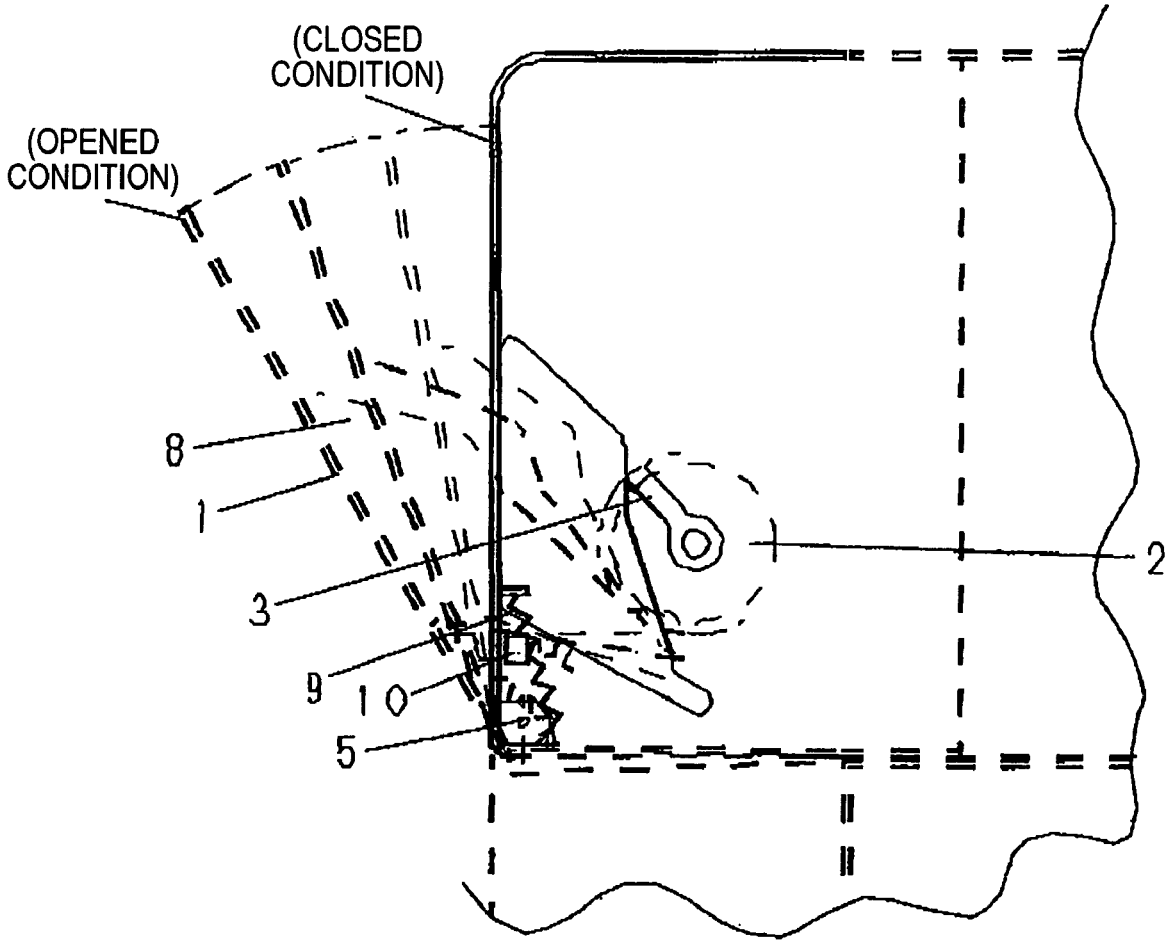
FIG. 5 is a view showing the structure for automatically opening and closing the exhaust opening cover of the first embodiment.

In this embodiment, as shown in FIG. 5, the apparatus comprises a cam 3 for transmitting the rotation of a motor shaft when the exhaust opening cover 1 (which is usually held in a closed condition, and is provided at a circulating fan exhaust opening 6 and the cooling means intake opening 22 which are provided at the upper portion of the apparatus), is opened and closed by power of the motor 2, a lever 8 for receiving a rotational motion of the cam and for converting it into a force to open and close the cover 1, and springs 9 interconnecting the apparatus body and the cover 1 to normally urge the cover 1 in its closing direction. When the motor 2 is rotated, the rotation of the cam 3, connected to the motor shaft, is transmitted to the lever 8, and the cover 1 is held stationary in an open condition in a predetermined position. Also, by again driving the motor 2, the cover 1 is moved from the open position into a predetermined position where the lever 8 is brought out of interlocking engagement with the cam 3, so that the cover 1 can make a smooth opening and closing motion, utilizing a pulling force of the equipped springs 9.

Figure 6:
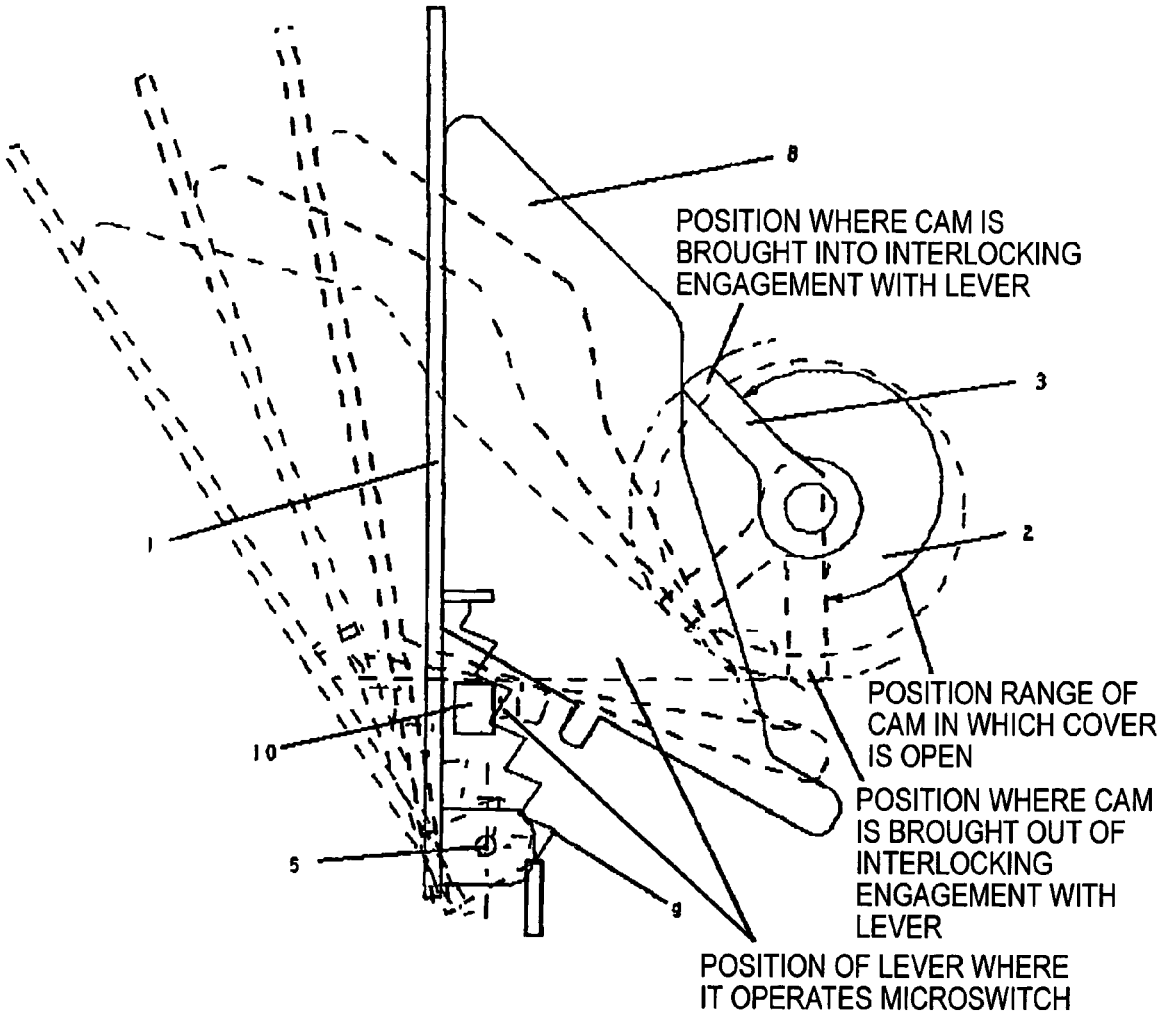
FIG. 6 is a view showing the principle of operation of a cam and a lever (structural members) for achieving an optimum angle of opening of the exhaust opening cover of the first embodiment.

In FIG. 6, in order that the exhaust opening cover 1 can be kept stationary at an optimum opening angle, the lever 8, rotating in interlocking relation to the cam 3, moves the cover 1 in the opening direction, and when the cover 1 reaches the predetermined optimum open position, the lever 8 operates a microswitch 10, and a microcomputer control portion 23 reads this signal to stop the operation of the motor 2. With this control construction, the exhaust opening cover 1 can be stably kept open in the optimum position. Also, when the cover 1 is kept stationary in the optimum open position, and the circulating fan 11 is stopped, the motor 2 receives this signal from the microcomputer control portion 23, and is again driven in the same direction. At this time, the cam 3 and the lever 8 act in an interlocked condition so as to move the cover 1 in the closing direction, but the two are brought out of interlocking engagement with each other in a certain position, so that the cover 1 can be completely closed by the pulling force of the equipped springs 9, and the smooth opening and closing movement can be achieved.

Figure 4A:
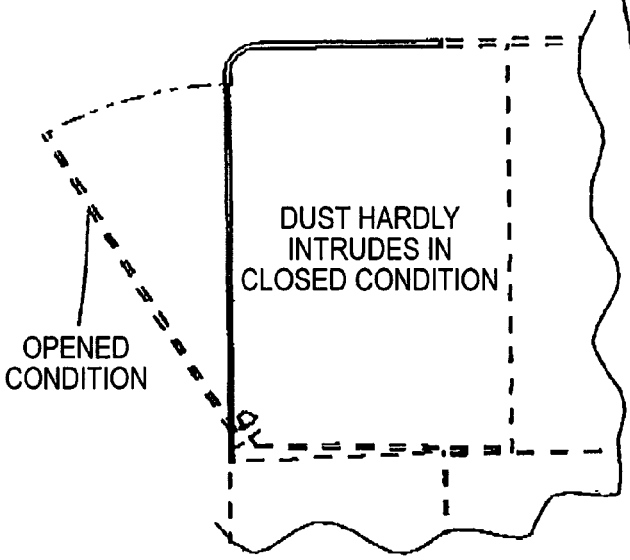
FIGS. 4A and 4B are views showing a comparison between the exhaust opening cover structure and a conventional exhaust opening cover structure.
Figure 4B:
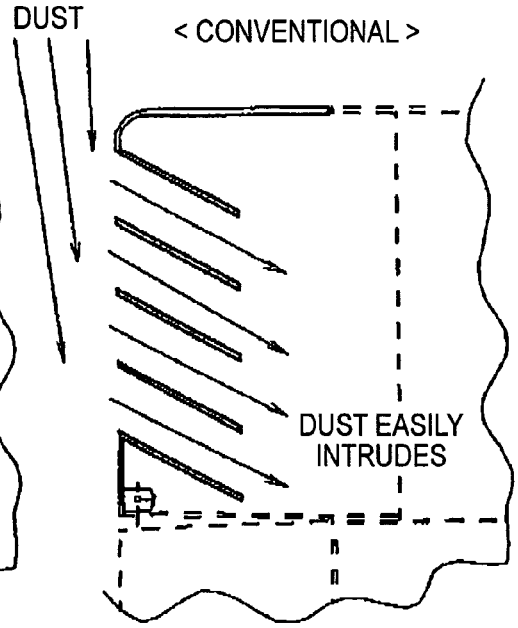

As shown in FIG. 4, by driving the exhaust opening cover by the motor, the exhaust opening can be closed when the apparatus is in the inoperative condition, and also the exhaust opening can be opened and closed only when necessary, and the intrusion of dirt and dust from the exterior can be prevented, thereby enhancing the degree of sanitation of the interior of the apparatus and also preventing the clogging of the exhaust opening portion.

According to the first embodiment, a structure of the invention comprises a cam for transmitting the rotation of a motor shaft when an exhaust opening cover, which is provided at a circulating fan exhaust opening at an upper portion of an apparatus, and is normally closed, is opened and closed by power of a motor, a lever for receiving a rotational motion of the cam and for converting it into a force to open and close the cover, and a spring interconnecting an apparatus body and the cover to apply a force in a direction to normally close the cover, and when the motor is rotated, the rotation of the cam, connected to the motor shaft, is transmitted to the lever so as to hold the cover stationary in an open condition in a predetermined position.

The motor is again driven from the cover open position to bring the cam and the lever out of interlocking engagement with each other in a predetermined position, so that the cover can make the smooth opening and closing movement, utilizing a pulling force of the spring, and therefore the quality can be greatly stabilized.

Further, the lever, rotating in interlocking relation to the cam in order to hold the exhaust opening cover stationary in a open condition at an optimum angle, moves the cover in the opening direction, and when the cover reaches the predetermined optimum open position, the lever operates a microswitch, and a microcomputer control portion reads this signal, and stops the operation of the motor. With this control construction, the exhaust opening cover can be stably opened in the optimum position, and the opening/closing mechanism, having the excellent durability and stable quality, can be achieved.

Further, when the cover is kept stationary in the optimum open position, and a circulating fan is stopped, the motor receives this signal from the microcomputer control portion, and is against driven in the same direction. At this time, the cam and the lever act in an interlocked condition so as to move the cover in the closing direction, but the two are brought out of interlocking engagement with each other in a certain position, so that the cover can be completely closed by the pulling force of the equipped spring, and the smooth opening and closing movement can be achieved with the simple construction.

Further, during the operation of heating means, the exhaust opening is opened by the interlocking operation of the cam and lever to thereby secure an intake opening. By doing so, an electric part (heating member) can be cooled during the operation of the heating means, so that the stable cooling ability can be achieved.

Further, when the cover is kept stationary in the optimum open position, and the cooling means is stopped, the motor receives this signal from the microcomputer control portion, and is again driven in the same direction. At this time, the cam and the lever act in an interlocked condition so as to move the cover in the closing direction, but the two are brought out of interlocking engagement with each other in a certain position, so that the cover can be completely closed by the pulling force of the equipped spring, and the smooth opening and closing movement can be achieved with the simple construction when the operation of the heating means is finished.

Second Embodiment

Figure 7:
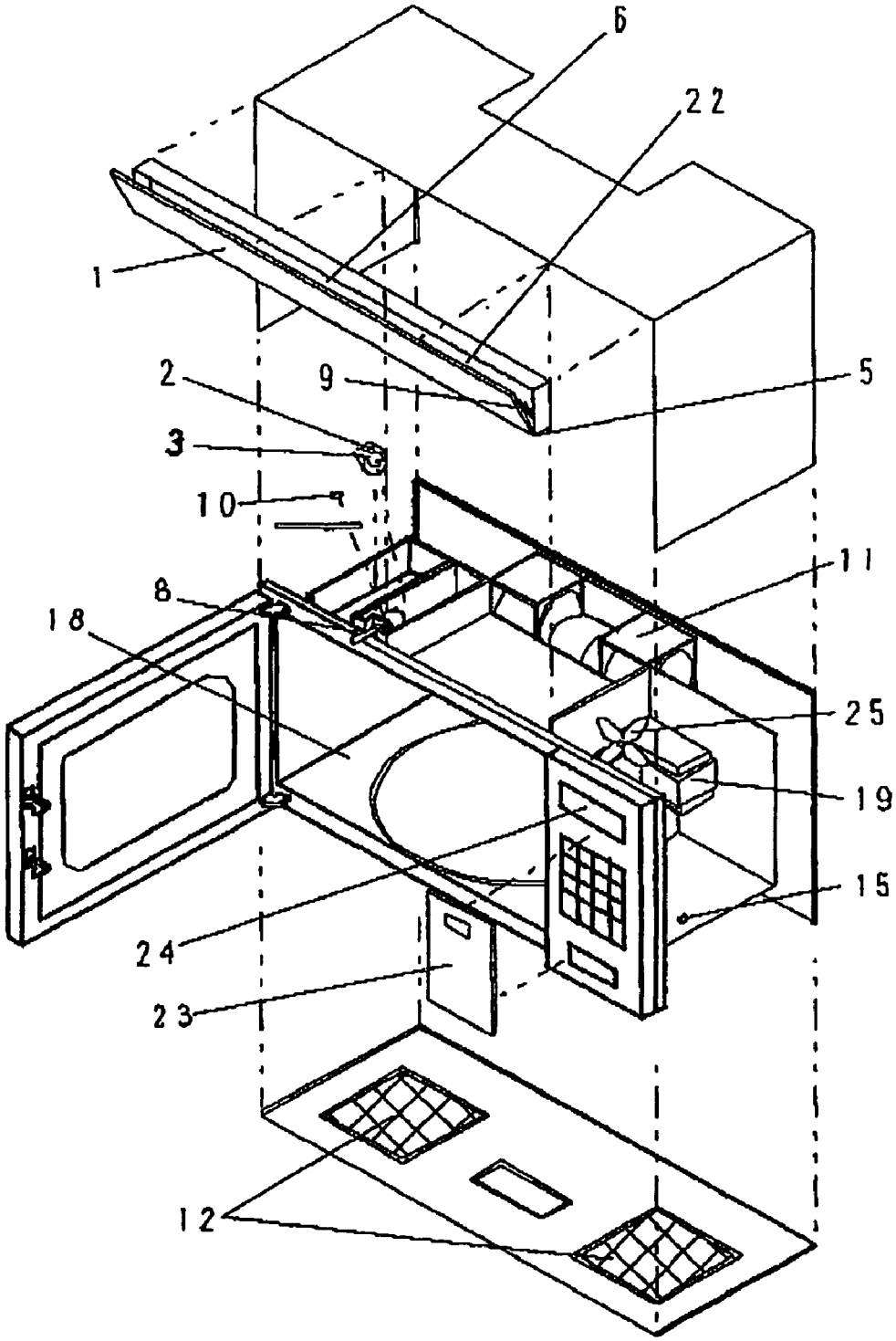
FIG. 7 is a view showing the internal structure of the oven hood-equipped high-frequency heating apparatus of the second embodiment provided with the exhaust opening cover.

In FIGS. 1 and 7, the exhaust opening cover 1, provided with the automatic opening/closing device, is so constructed that gas 14, generated from cooking devices 13 (installed below the exhaust opening cover) during the cooking, is drawn up through bottom surface intake openings 12 by a circulating fan 11, and is circulated to be exhausted into a room through an upper surface portion of an apparatus body when the exhaust opening cover 1 (which can be automatically opened and closed by driving a motor 2 of an ordinary specification which is not limited in rotational direction, and therefore is rotatable in both directions) is in an open condition, and that an intake opening 22 for cooling an electric part (serving as a heating member) during an operation of heating means 19 is provided at the exhaust opening cover 1 disposed at an upper portion of the apparatus body. The operation and effects of the oven hood-equipped high-frequency heating apparatus, having the exhaust opening cover 1 provided with the automatic opening/closing device of the above construction, will be described below.

Figure 8A:
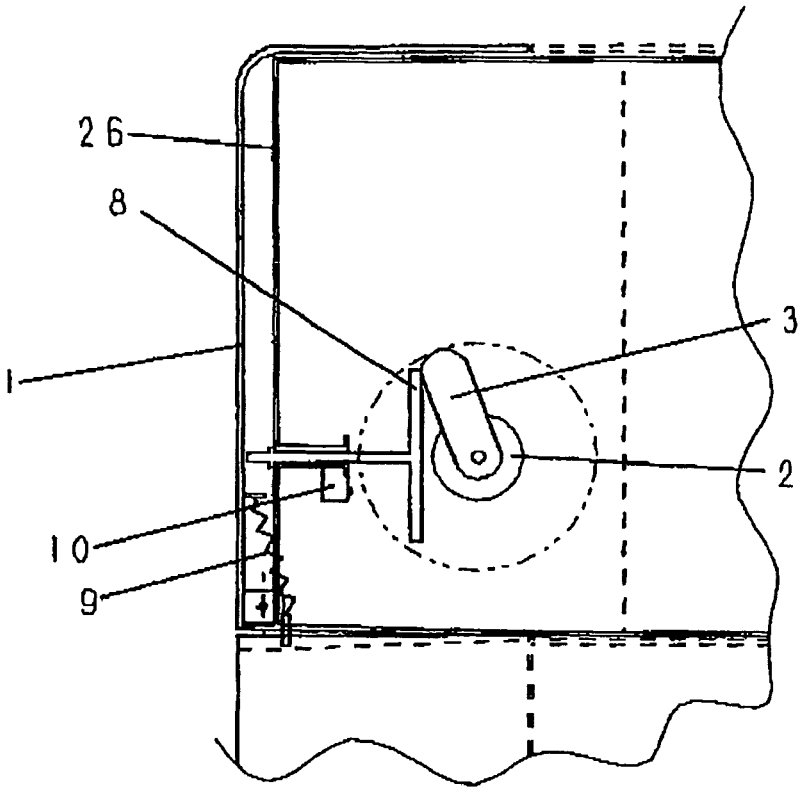
FIGS. 8A and 8B are views showing the structure for automatically opening and closing the exhaust opening cover of the second embodiment.
Figure 8B:
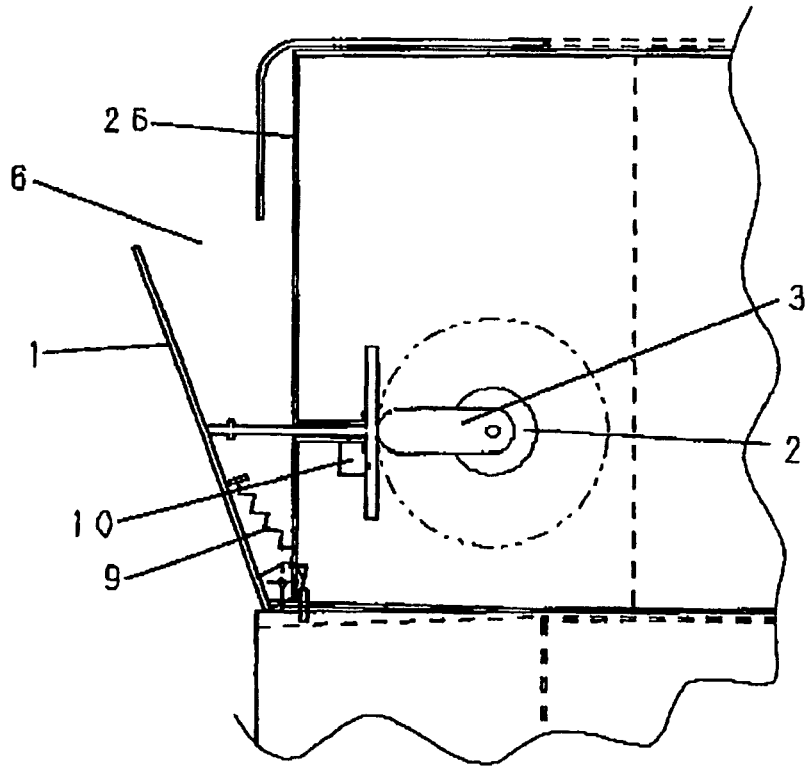

In this embodiment, as shown in FIGS. 8A and 8B, the apparatus comprises a cam 3 for transmitting the rotation of a motor shaft when the exhaust opening cover 1 (which is usually held in a closed condition, and is provided at a circulating fan exhaust opening 6 and the cooling means intake opening 22 which are provided at the upper portion of the apparatus), is opened and closed by power of the motor 2, a lever 8 for receiving a rotational motion of the cam and for converting it into a force to open and close the cover 1, and springs 9 interconnecting the apparatus body and the cover 1 to normally urge the cover 1 in its closing direction. When the motor 2 is rotated, the rotation of the cam 3, connected to the motor shaft, is transmitted to the lever 8, and the cover 1 is held stationary in an open condition in a predetermined position. Also, by again driving the motor 2, the cover 1 is moved from the open position into a predetermined position where the lever 8 is brought out of interlocking engagement with the cam 3, so that the cover 1 can make a smooth opening and closing motion, utilizing a pulling force of the equipped springs 9.

Figure 9A:
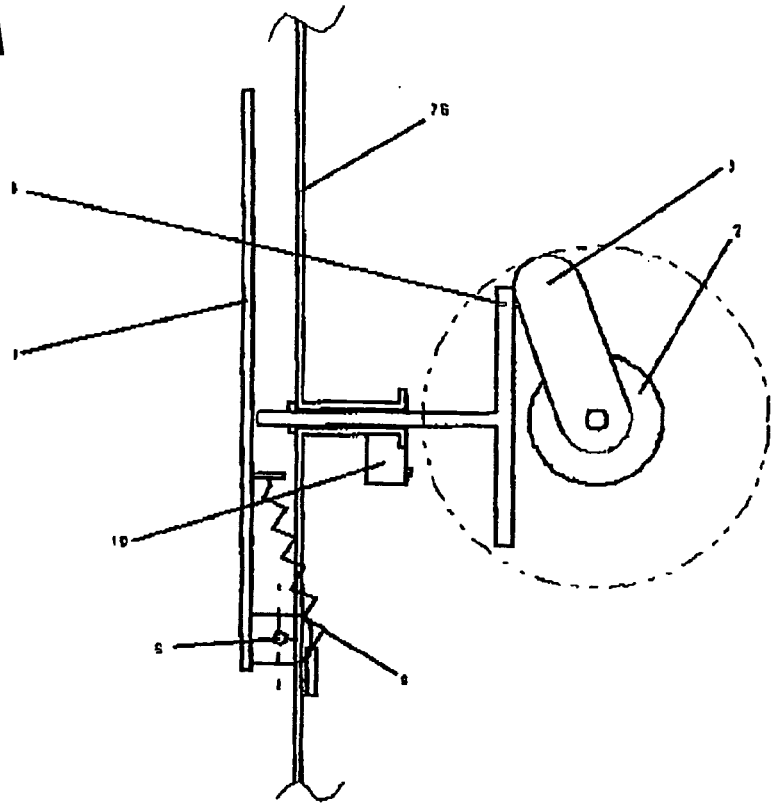
FIGS. 9A and 9B are views showing the principle of operation of a cam and a lever (structural members) for achieving an optimum angle of opening of the exhaust opening cover of the second embodiment.
Figure 9B:
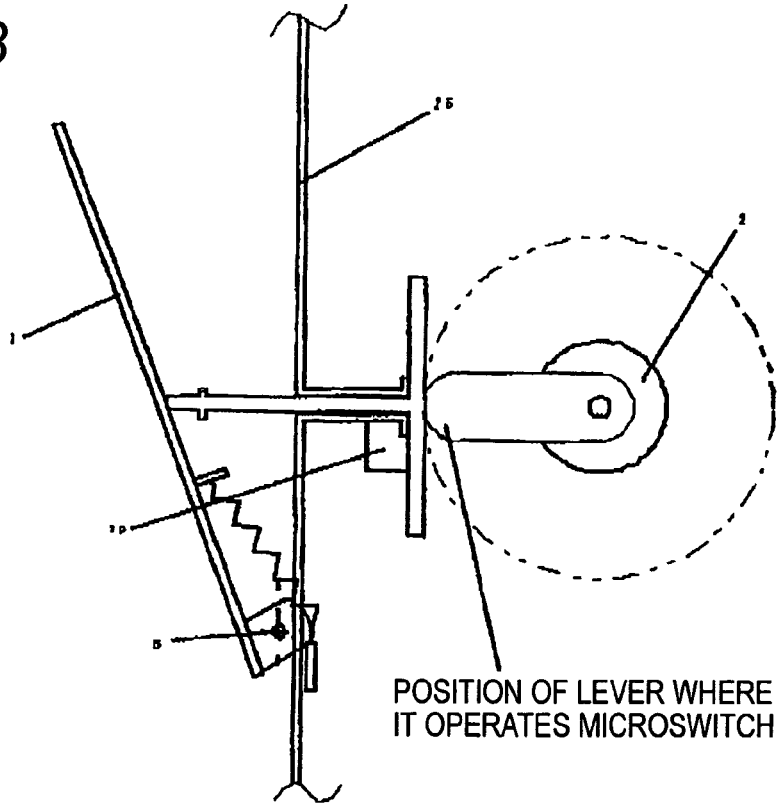

In FIGS. 9A and 9B, in order that the exhaust opening cover 1 can be kept stationary at an optimum opening angle, the lever 8, operating in association with the cam 3, moves in a direction to push the cover 1 forwardly, and when the cover 1 reaches the predetermined optimum open position, the lever 8 operates a microswitch 10, and a microcomputer control portion 23 reads this signal to stop the operation of the motor 2. With this control construction, the exhaust opening cover 1 can be stably kept open in the optimum position. Also, when the cover 1 is kept stationary in the optimum open position, and the circulating fan 11 is stopped, the motor 2 receives this signal from the microcomputer control portion 23, and is again driven. At this time, the direction of rotation of the motor is not limited, and the cam 3 and the lever 8 act in an interlocked condition so as to move the cover 1 in a closing direction, but the two are brought out of interlocking engagement with each other in a certain position, so that the cover 1 can be completely closed by the pulling force of the equipped springs 9, and the smooth opening and closing movement can be achieved.

As shown in FIG. 4, by driving the exhaust opening cover by the motor, the exhaust opening can be closed when the apparatus is in the inoperative condition, and also the exhaust opening can be opened and closed only when necessary, and the intrusion of dirt and dust from the exterior can be prevented, thereby enhancing the degree of sanitation of the interior of the apparatus and also preventing the clogging of the exhaust opening portion.

According to the second embodiment, the structure of the first invention comprises a cam for transmitting the rotation of a motor shaft when an exhaust opening cover, which is provided at a circulating fan exhaust opening at an upper portion of an apparatus, and is normally closed, is opened and closed by power of a motor, and a lever (serving as protruding means) for receiving a rotational motion of the cam so as to open the cover, and when the motor is rotated, the rotation of the cam, connected to the motor shaft, is transmitted to the lever, so that the lever protrudes the cover, and holds the cover stationary in an open condition in a predetermined position.

The motor is again driven in a reverse direction from the cover open position to draw the lever, and at the same time a pulling force of a spring (serving as the pressing means) is utilized, and by doing so, the cover can be smoothly closed, and therefore the smooth and stable opening and closing movement can be achieved.

Further, the apparatus comprises a cam for transmitting the rotation of a motor shaft when an exhaust opening cover, which is provided at a circulating fan exhaust opening at an upper portion of an apparatus, and is normally closed, is opened and closed by power of a motor, and a lever (serving as protruding means) for receiving a rotational motion of the cam so as to open the cover, and when the motor is rotated, the rotation of the cam, connected to the motor shaft, is transmitted to the lever, so that the lever protrudes the cover, and holds the cover stationary in an open condition in a predetermined position.

The motor is again driven in a reverse direction from the cover open position to draw the lever, and the cam is brought out of interlocking engagement with the lever in a predetermined position, so that the cover can be smoothly closed by a pulling force of a spring (pressing means), and therefore the smooth and stable opening and closing movement can be achieved.

Further, the protruding means for opening the cover is disposed near to a central portion of the cover, and therefore even the wide and heavy cover can be smoothly opened and closed by a small motor drive force, and the cover can be stably opened and closed in a highly durable manner.

Further, the pressing means for closing the cover are provided at opposite end portions of the cover, respectively, and therefore the pressing means can always be bidirectionally balanced with respect to the protruding means disposed near to the central portion of the cover, and a gap due to distortion and twisting of the wide cover will not develop, so that the cover can be stably opened and closed.

Further, the lever moves in association with the rotation of the cam to open the cover, and part of the lever pushes a switch to stop the opening movement. On the other hand, when a microcomputer control portion receives cooling means operation-stop information in the open condition of the cover, the driving of the motor is started, and the lever is brought out of interlocking engagement with the cam in a predetermined position, thereby closing the cover by a force of a spring interconnecting the cover and the body. Here, there is provided such a mechanism that even when the cam rotates in either direction, the lever, moving in interlocked relation to the cam, makes the same movement, and therefore there can be used the ordinary motor rotatable in both directions, and the opening/closing mechanism which is excellent in durability and stable in quality can be achieved.

Third Embodiment

Figure 10:
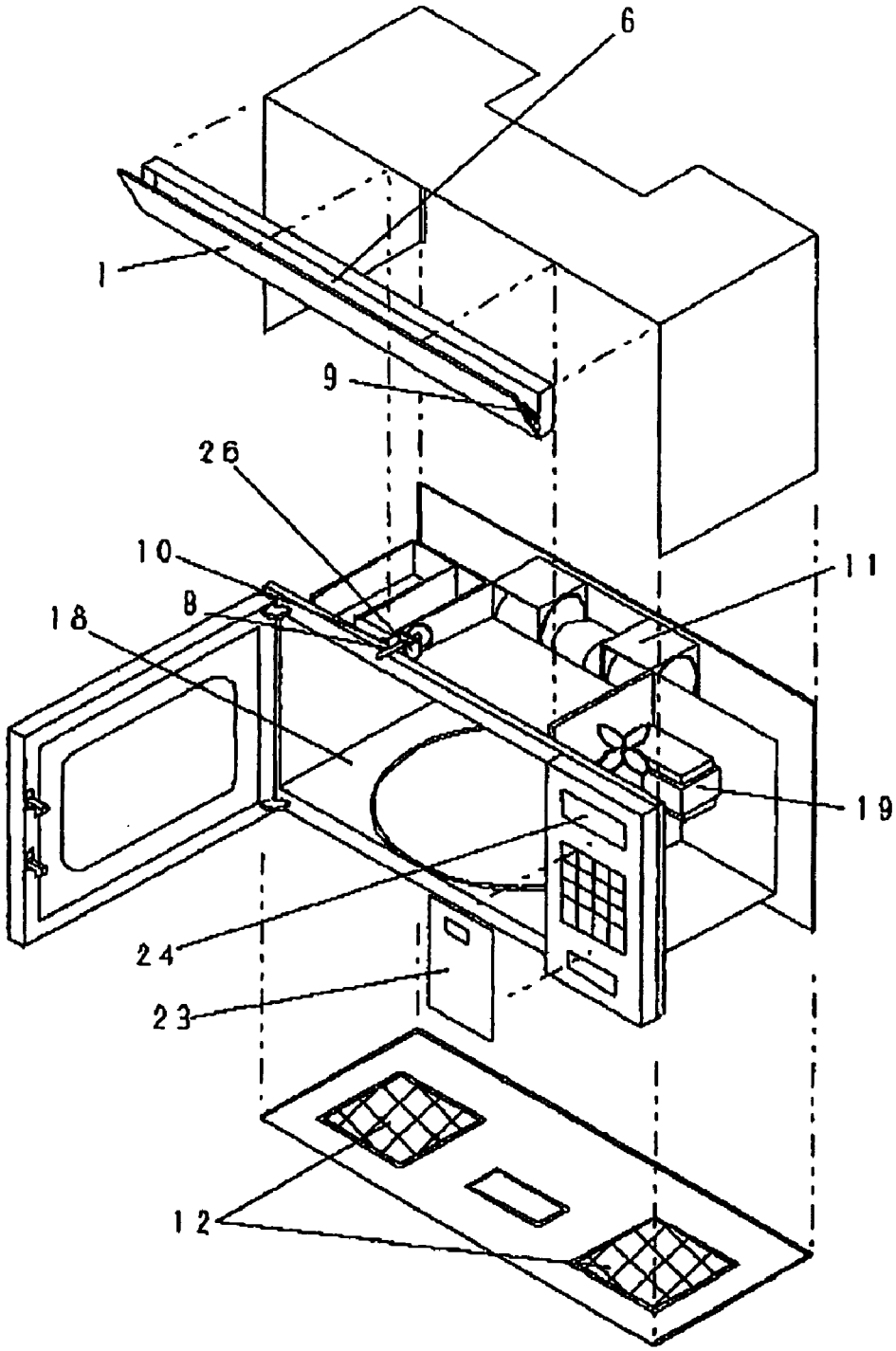
FIG. 10 is a view showing the internal structure of the oven hood-equipped high-frequency heating apparatus of the third embodiment provided with the exhaust opening cover.

In FIGS. 1 and 10, gas 14, generated from cooking devices 13 (installed below the exhaust opening cover) during the cooking, is drawn up through bottom surface intake openings 12 by a circulating fan 11, and is circulated to be exhausted into a room through an opening of the exhaust opening cover 1 automatically opened by a force of this exhaust current.

The operation and effects of the oven hood-equipped high-frequency heating apparatus, having the exhaust opening cover 1 provided with the automatic opening/closing device of the above construction, will be described below.

Figure 11A:
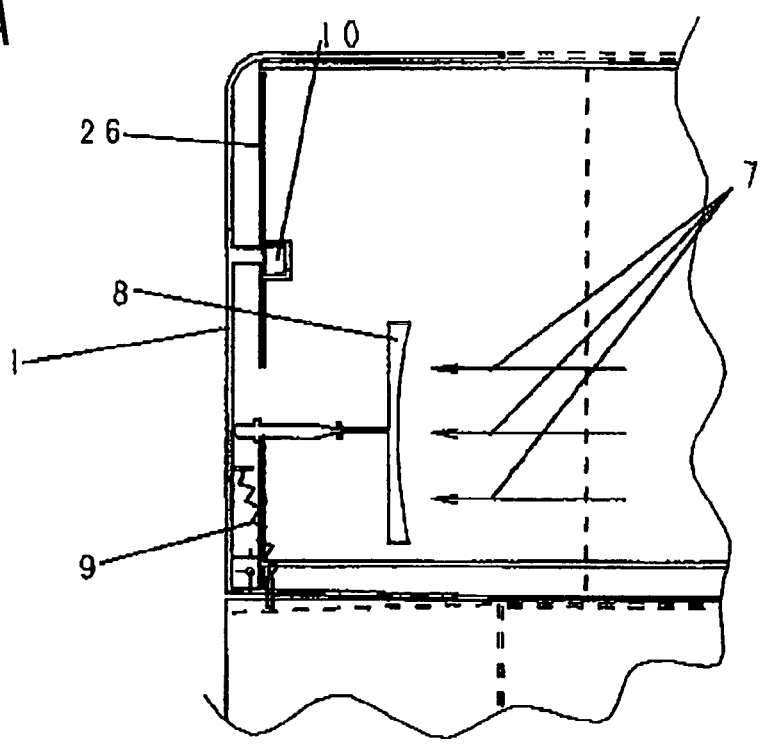
FIGS. 11A and 11B are views showing the structure for automatically opening and closing the exhaust opening cover of the third embodiment.
Figure 11B:
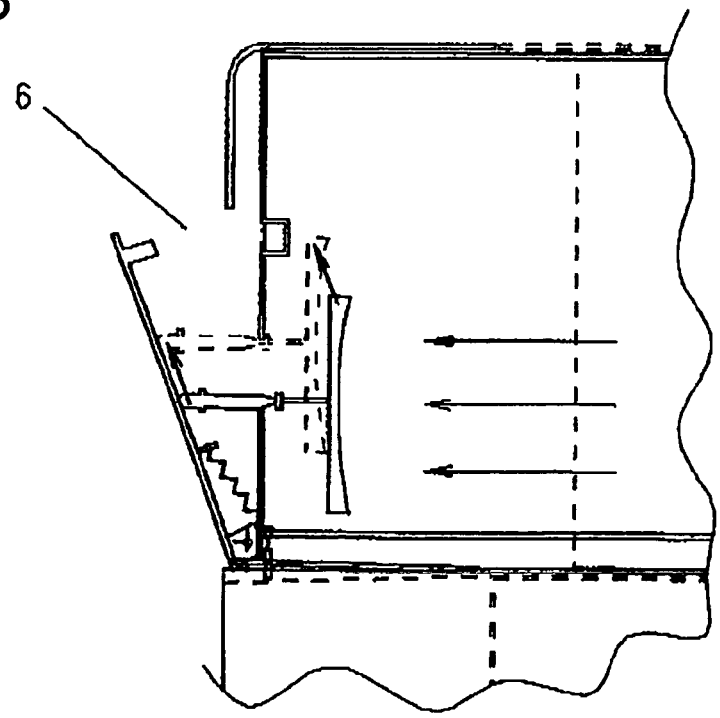

In this embodiment, as shown in FIGS. 11A and 11B, the exhaust opening cover 1 (which is usually held in a closed condition, and is provided at a circulating fan exhaust opening 6 provided at an upper portion of the apparatus) is opened when a current-receiving portion, provided at a lever 8, is pushed out by a strong exhaust current (of a Max. 300CFM level) produced by operating the circulating fan. When the operation of the circulating fan is stopped, a pushing force of the exhaust current is not supplied to the lever 8, and the cover 1 is returned by springs 9 interconnecting an apparatus body and the cover 1, and part of the cover 1 operates a microswitch, so that the cover 1 is completely closed.

Figure 12A:
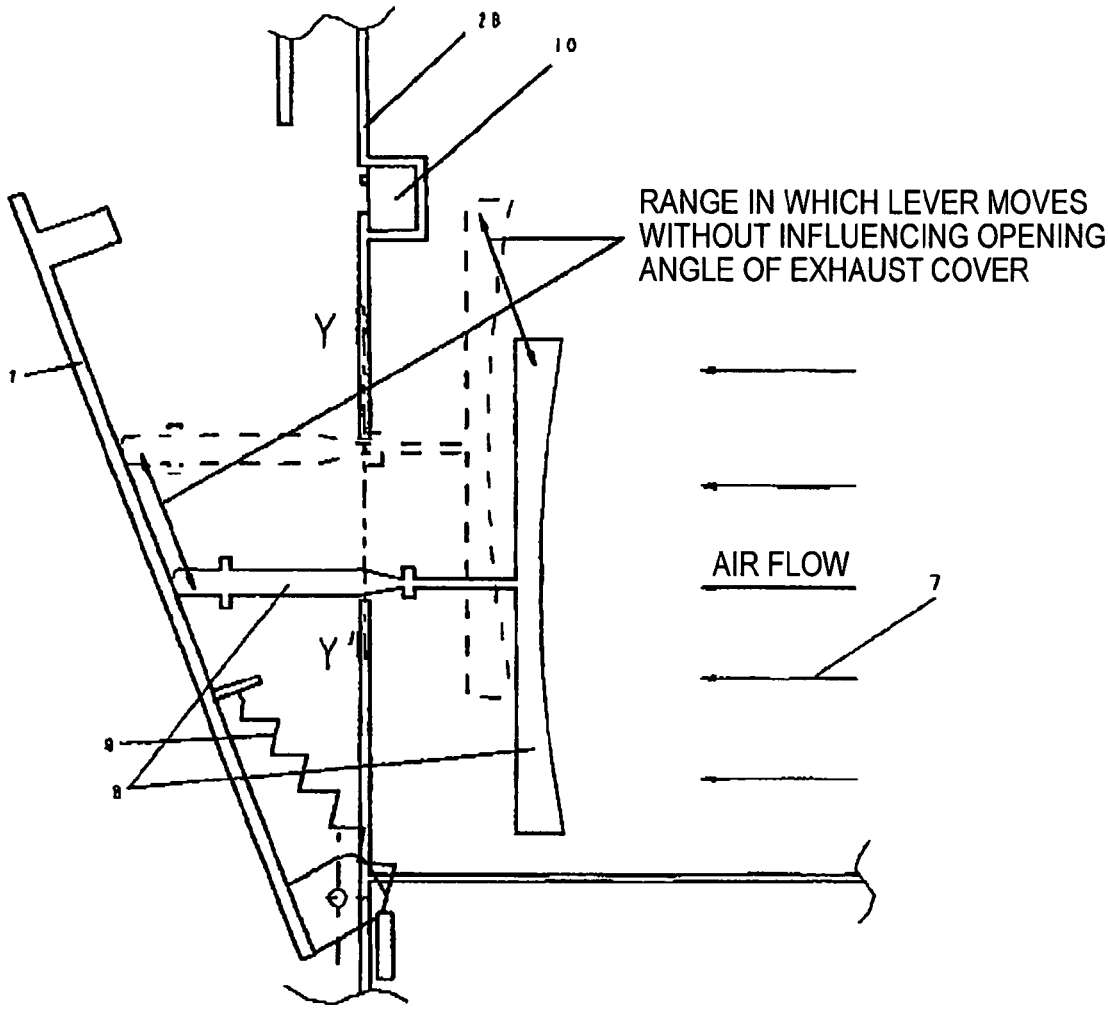
FIGS. 12A and 12B are views showing the principle of the structure of the third embodiment capable of stably maintaining an angle of opening of the exhaust opening cover even with an unstable air current.
Figure 12B:
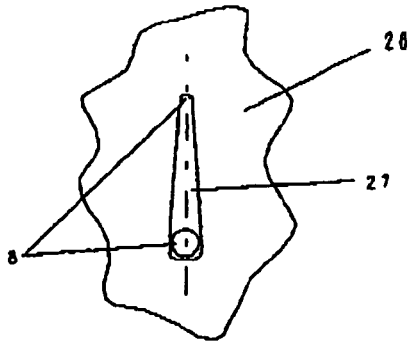

In FIGS. 12A and 12B, when the lever 8 receives an exhaust current 7 from the circulating fan 11, this lever 8 is pushed out to move in a direction to open the cover 1 in a pushing manner. When the cover 1 is pushed to be opened at a maximum angle, a tapered (or narrowed) portion of the lever 8 is engaged in a slit 27 formed in a holding portion. Further, the lever 8, receiving an exhaust current 7, intends to move in a direction to push out the cover 1, but the tapered portion of the lever 8 is pushed upward along the slit 27 (formed in the holding portion) which is tapering toward one end thereof as shown in a cross-sectional view taken along the line Y-Y'. At this time, the pushed-out lever 8 moves along an inclination of the cover 1, and therefore although the lever 8 is pushed out, the cover 1 remains stationary in the position where the maximum opening angle is maintained.

Therefore, even when the force of the exhaust current is not constant, the maximum angle of opening of the cover 1 can be maintained during the time when the tapered portion of the lever 8 moves upward along the slit 27 (formed in the holding portion) tapering toward the one end thereof. Therefore, even when the force of the exhaust current varies, the cover is prevented from fluttering, and the maximum opening angle can be stably maintained.

As shown in FIG. 4, the exhaust opening cover 1 can be automatically opened and closed by the exhaust current, and by doing so, the exhaust opening can be closed when the apparatus is in an inoperative condition, and also the exhaust opening can be opened and closed only when necessary, and the intrusion of dirt and dust from the exterior can be prevented, thereby enhancing the degree of sanitation of the interior of the apparatus and also preventing the clogging of the exhaust opening portion.

Figure 14:
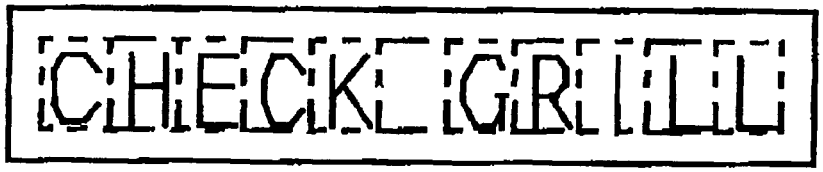
FIG. 14 is an illustration showing an indication telling of an abnormality of the exhaust opening cover of the embodiment of the invention.

In FIG. 14, when the cover is closed by some external factor during the cooking, a switch 10 is operated, and a microcomputer control portion 23 reads this signal, and the operation of the circulating fan is stopped, and at the same time an opening/closing abnormal condition is indicated as "CHECK GRILL" or "GRILL MALFUNCTION" in the apparatus operation display portion 24, thus immediately telling the user of the abnormal portion. Therefore, a malfunction of the circulating fan 11 is prevented, and besides the user can be told of the abnormal portion, and the quality and service can be enhanced.

According to third embodiment, an exhaust opening cover, which is provided at a circulating fan exhaust opening (provided at an upper portion of an apparatus), and is usually closed, is opened and closed, utilizing an exhaust current from a circulating fan without the use of a motor power. When a lever receives an exhaust current from the circulating fan, this lever is moved to be pushed out, thereby opening the cover.

Further, the cover pushing-out means obtains power through a portion thereof for receiving the exhaust current from the circulating fan, and the cover pushing-out means can make a stable movement through a holding portion so as to push out the cover, and a protruding portion of this cover pushing-out means can push the cover to open the same.

Further, a slit is formed in the holding portion, and this slit is so shaped that it is tapering toward one end thereof, and one end portion of the protruding portion is tapered so as to slide along the tapering slit. With this construction, the range in which the pushing-out means can move in accordance with the force of the exhaust current can be secured while maintaining the maximum opening angle of the cover, and the maximum opening/closing angle of the cover can be stably maintained even when the exhaust current is not constant.

Further, the tapered portion of the protruding portion is formed into a generally conical shape, and therefore this tapered portion can smoothly move in and along the slit formed in the holding portion, and the pushing-out means can be smoothly moved upon receipt of the exhaust current.

Further, pressing means for closing the cover are provided at opposite end portions of the cover, respectively, and therefore the pressing means can always be bidirectionally balanced with respect to the protruding means disposed near to a central portion of the cover, and a gap due to distortion and twisting of the wide cover will not develop, so that the cover can be stably opened and closed.

Further, when the cover is forcibly closed by some external factor during the operation of the circulating fan, a microswitch is operated to stop the operation of the circulating fan. By doing so, an overheating malfunction of the circulating fan, which is caused by the overloading of a motor in the closed condition of the exhaust opening, can be prevented, and the opening/closing mechanism of a stable quality can be achieved.

Fourth Embodiment

Figure 13A:
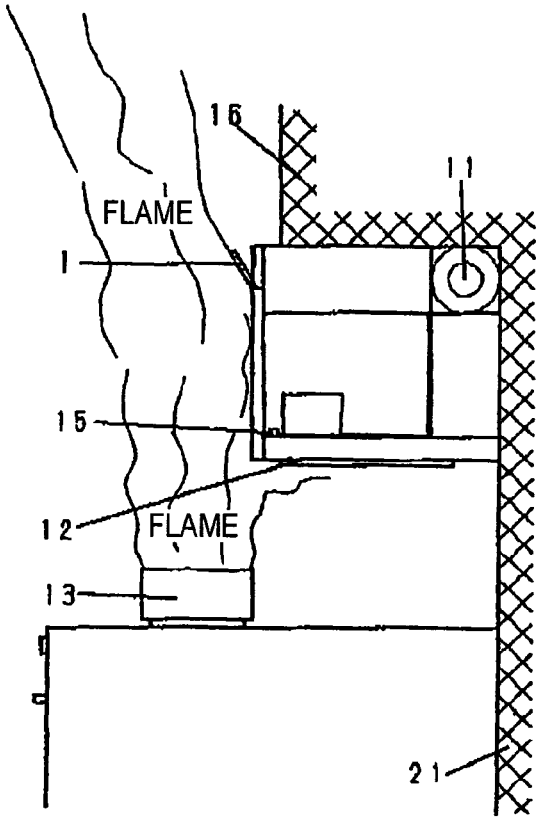
FIGS. 13A and 13B are views showing a comparison between effects obtained at the time of occurrence of a fire at a cooking device below an exhaust opening cover of embodiments of the invention.
Figure 13B:
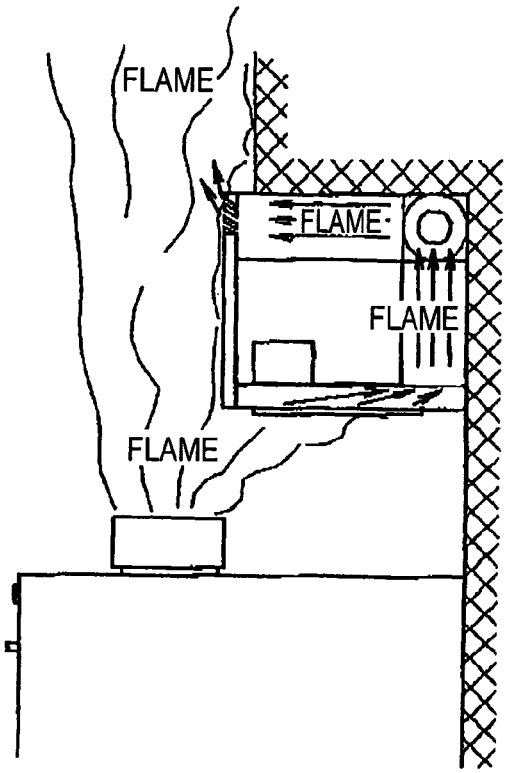

FIGS. 13A and 13B show effects, obtained when a fire occurs at a cooking device below an exhaust opening cover of an embodiment of the invention, by way of comparison.

FIG. 13A shows the construction using the embodiment of the invention, and an oven hood-equipped high-frequency heating apparatus includes the exhaust opening cover 1, a circulating fan motor 11, a bottom surface intake opening 12, and temperature detection means 15 for detecting a fire occurring at the cooking device 13 located below the apparatus. A storage cabinet 16 is provided at an upper side of the apparatus.

FIG. 13B shows a conventional construction.

The operation and effects of the oven hood-equipped high-frequency heating apparatus of the above construction will be described below.

In FIG. 13A, when a fire occurs at the cooking device 13 located below the apparatus, the fire detection means 15, provided at a lower portion of the apparatus, detects an abnormality, and this signal is fed to a microcomputer control portion 23, so that the operation of the circulating fan 11 is stopped, and at the same time the exhaust opening cover 1 is stopped in an open condition. As a result, a flame of the fire is prevented from intruding into the interior of an apparatus body by a drawing operation of the circulating fan 11, and besides since the exhaust opening cover 1 is stopped in the open condition, the flame can be prevented from propagating over the surface of the apparatus, thereby preventing the storage cabinet 16 from catching a spreading fire, and therefore the safety can be greatly enhanced when an abnormality, such as a fire, occurs.

And besides, when the cover 1 in the open condition is forcibly closed by an external factor during the operation of the circulating fan or heating means 9, an exhaust opening 6 for the circulating fan 11 and a cooling means intake opening 22 are closed, and therefore a motor 2 and the heating means 19 are overheated, and a malfunction occurs if the motor 2 and the heating means 19 continue their operation. However, a switch 10 in the ON-state is turned off by a lever 8 moving in interlocking relation to the cover 1, and the microcomputer control portion 23 reads this signal to stop the operation of the fan 11, thereby preventing a malfunction due to overheating of the circulating fan 11 and heating means 19.

Furthermore, when an abnormality occurs in the opening and closing of the cover during the cooking, the switch 10 in the ON-state is turned off, and the microcomputer control portion 23 reads this signal to stop the operation of the apparatus. At this time, an opening/closing abnormal condition is indicated as "CHECK GRILL" or "GRILL MALFUNCTION" in a display portion 24 of the apparatus body as shown in FIG. 14, thus telling the user of the abnormal portion.

Figure 15:
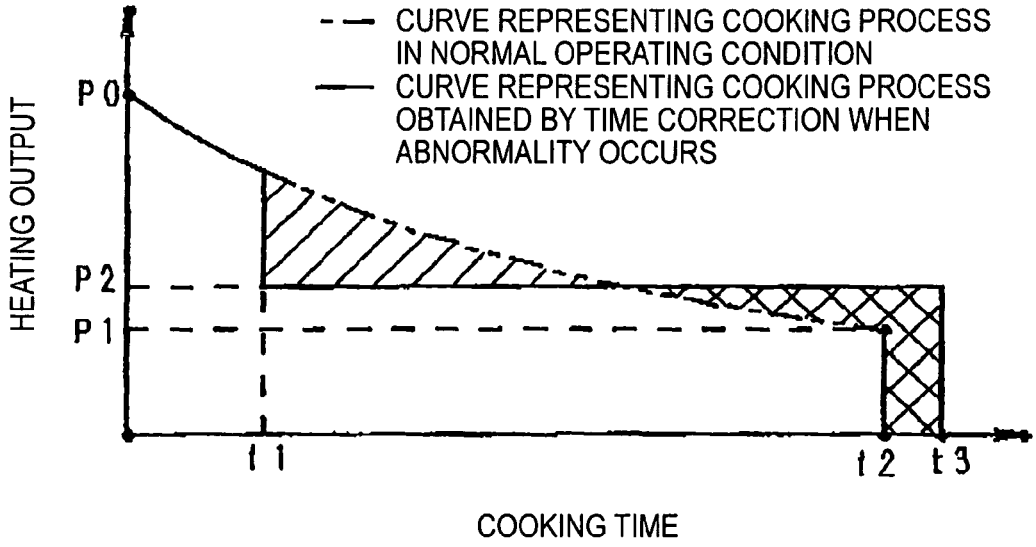
FIG. 15 is a diagram showing a method of correcting a cooking time when an abnormality occurs in the opening and closing of the exhaust opening cover of the embodiment of the invention during the cooking.

Furthermore, when the cover 1 is closed in the event of an abnormality in the opening and closing of the cover 1 during the operation of the heating means 19, the ability of cooling the heating means 19 becomes insufficient. However, the heating output is lowered by controlling the heating means 19, thereby ensuring the operation even with the low cooling ability, so that the cooking can be continued without stopping the operation of the heating means 19. Also, as shown in FIG. 15, a correction calculation for extension of the heating time is effected so that a total heating amount which a stuff to be heated receives for a time period from a time of occurrence of an abnormality to an original cooking-finish time in a normal condition will be equal to a total heating amount which the stuff to be heated receives after the lowering of the heating output, and the microcomputer control portion 23 effects a heating control. By doing so, the same cooking results as obtained in the normal operating condition can be obtained, and even when an abnormality occurs in the opening and closing of the cover 1 during the cooking, the satisfactory cooking performance equivalent to that obtained in the normal operating condition can be obtained without stopping the heating operation.

According to the fourth embodiment, in the event of an abnormality such as a fire occurring at a cooking device provided below the apparatus, abnormal temperature detection means feeds a signal by which the operation of the circulating fan is stopped, and at the same time the exhaust opening cover is also stopped in the open condition. As a result, a flame of the fire is prevented from intruding into the interior of the apparatus body by a drawing operation of the circulating fan, and besides the exhaust opening cover in the open condition can prevent the flame from propagating over the surface of the apparatus, thereby preventing a storage cabinet, located above the apparatus, from catching a spreading fire, and therefore the safety can be greatly enhanced when an abnormality, such as a fire, occurs.

Further, when the cover is forcibly closed by an external factor, the exhaust opening for the circulating fan is closed, and therefore the motor is overloaded, and is heated, and a malfunction occurs if the motor continues its operation. However, the switch in the ON-state is turned off by the lever moving in interlocking relation to the cover, and the microcomputer control portion reads this signal to stop the operation of the fan, thereby preventing a malfunction due to overheating of the circulating fan.

Further, when the cover is forcibly closed by an external factor, the exhaust opening for the circulating fan is closed, and therefore the motor is overloaded, and is heated, and a malfunction occurs if the motor continues its operation. However, the switch in the ON-state is turned off by the lever moving in interlocking relation to the cover, and the microcomputer control portion reads this signal, so that an opening/closing abnormal condition is indicated as "CHECK GRILL" or "GRILL MALFUNCTION" in an apparatus operation display portion as shown in FIG. 14, thus easily telling the user of the abnormal portion. By thus finding the abnormal condition at an early stage, the malfunction can be minimized, and also the service for the parts can be enhanced.

Further, when the cover is forcibly closed by an external factor during the operation of the heating means, the ability of cooling the heating means becomes insufficient. However, a heating output is lowered by controlling the heating means, thereby ensuring the operation even with the low cooling ability, so that the cooking can be continued without stopping the operation of the heating means, and the cooking can be completed without stopping the operation even when an abnormality occurs during the cooking. Also, as shown in FIG. 15, taking into consideration a time period from a time of occurrence of an abnormality to a cooking finish time and a total heating amount which a stuff to be heated receives after the lowering of the heating output, a heating control is effected on the basis of a correction calculation by a microcomputer so that the same cooking results as obtained in the normal operating condition can be obtained, and by doing so, the stable cooking performance can be achieved even when an abnormality occurs.

Further, when the cover is forcibly closed by an external factor during the heating operation, the heating output is controlled, so that the cooking can be continued without stopping the operation of the heating means. At this time, the switch in the ON-state is turned off by the lever moving in interlocking relation to the cam, and the microcomputer control portion reads this signal, so that an opening/closing abnormal condition is indicated as "COOKING TIME ADJUSTED", "CHECK GRILL" or "GRILL MALFUNCTION" in the apparatus operation display portion as shown in FIG. 14, thus easily telling the user of the abnormal portion or cooking process information. By thus finding the abnormal condition at an early stage, the malfunction can be minimized, and also the service for the parts can be enhanced.

INDUSTRIAL APPLICABILITY

As described above, the oven hood-equipped high-frequency heating apparatus of the present invention enables the smooth stable opening and closing operation with the simple construction, and can provide the opening/closing means which is safe, and is excellent in durability and appearance grade, and therefore the invention can be applied also to a motor-driven automatic opening/closing construction and so on.

As described above, the oven hood-equipped high-frequency heating apparatus of the present invention enables the smooth stable opening and closing operation with the simple construction, and can provide the opening/closing means which is safe, and provides an improved warranty on the quality of the parts in the event of an abnormal operation, and is excellent in appearance grade, and therefore the invention can be applied also to an automatic opening/closing construction, etc,. which does not utilize a motor driving force.

What is claimed is:

1. An oven hood-equipped high-frequency heating apparatus including an opening for exhaust or intake purposes, and a cover for covering said opening, said apparatus comprising:

means for heating the stuff to be heated;

means for cooling said means for heating;

means for opening and closing said cover; and means for controlling the opening and closing of said cover;

wherein said means for opening and closing includes protruding means for opening said cover in association with the driving of a motor, and pressing means for closing said cover; and a cam is provided at said protruding means, and said protruding means is operable in association with the rotation of said cam so as to open and close said cover, and when said cover reaches a predetermined position, the driving of the motor is stopped to keep said cover in an open condition, and when said cover in the open condition is to be closed, the driving of the motor is further started from the position where said cover has reached said predetermined position, so that said cam is brought out of interlocking engagement with said protruding means, thereby closing said cover.

2. An oven hood-equipped high-frequency heating apparatus according to claim 1, wherein said protruding means for opening said cover in association with the driving of the motor is provided in a space which is disposed adjacent to a circulating fan exhaust opening portion and also near to a central portion of said cover, and is separated from an exhaust opening by a partition.

3. An oven hood-equipped high-frequency heating apparatus according to claim 1, wherein said pressing means for closing said cover are provided at opposite end portions of said cover, respectively.

4. An oven hood-equipped high-frequency heating apparatus according to claim 1, wherein said motor for effecting the opening and closing operation can be rotated in both directions, and therefore can be driven in both directions, and there is provided cover opening means in which part of a lever pushes a switch to stop the driving of the motor, and in the open condition of said cover, the driving of the motor is again started in accordance with cooling means operation-stop information, so that said lever is brought out of interlocking engagement with said cam, thereby closing said cover by a force of a spring of said pressing means.

5. An oven hood-equipped high-frequency heating apparatus according to claim 1, wherein a lever is supported by an apparatus body-constituting part, and there is provided an upper opening which is closed and opened when said lever is moved in association with a rotation of a cam, and said opening/closing means is constructed such that when an abnormality is detected by abnormality detection means, the operation of a circulating fan is stopped, and also said cover is kept stationary in the open condition.

6. An oven hood-equipped high-frequency heating apparatus according to claim 1, wherein when said cover is forcibly closed by an external factor during the operation of a circulating fan, a switch is turned into the OFF state, thereby stopping the operation of said circulating fan.

7. An oven hood-equipped high-frequency heating apparatus according to claim 6, wherein when said cover is forcibly closed by an external factor during the operation of said circulating fan, and said switch is turned into the OFF state, thereby stopping the operation of said circulating fan, an indication is provided, telling of an abnormality in the opening/closing of the opening/closing opening cover, at an apparatus operating condition display portion.

8. An oven hood-equipped high-frequency heating apparatus according to claim 1, wherein when said cover is forcibly closed by an external factor during the operation of said heating means, a switch is turned into the OFF state, thereby stopping the operation of said heating means or controlling said heating means so as to control a heating output into such a degree that a cooling ability can be obtained even in the closed condition of said cover.

9. An oven hood-equipped high-frequency heating apparatus according to claim 8, wherein when said cover is forcibly closed by an external factor during the operation of said heating means, and said switch is turned into the OFF state, thereby stopping the operation of said heating means or controlling a heating output, an indication, telling of the fact that the heating cooking operation is stopped, or is controlled in accordance with an abnormality in the opening/closing of said cover, is provided at a display portion.

* * * * *